US010695240B2

(12) United States Patent
Garland et al.

(10) Patent No.: US 10,695,240 B2
(45) Date of Patent: Jun. 30, 2020

(54) VEHICLE RAMP ASSEMBLY

(71) Applicant: Airbus Defence and Space Limited, Stevenage, Hertfordshire (GB)

(72) Inventors: Martin Garland, Hertfordshire (GB); David Lines, Hertfordshire (GB); Daisy Lachat, Hertfordshire (GB); Jo Remion, Hertfordshire (GB)

(73) Assignee: AIRBUS DEFENCE AND SPACE LIMITED, Stevenage, Hertfordshire (GB)

( * ) Notice: Subject to any disclaimer, the term of this patent is extended or adjusted under 35 U.S.C. 154(b) by 0 days.

(21) Appl. No.: 16/342,405

(22) PCT Filed: Oct. 19, 2017

(86) PCT No.: PCT/EP2017/076769
§ 371 (c)(1),
(2) Date: Apr. 16, 2019

(87) PCT Pub. No.: WO2018/073374
PCT Pub. Date: Apr. 26, 2018

(65) Prior Publication Data

US 2020/0054508 A1 Feb. 20, 2020

(30) Foreign Application Priority Data

Oct. 21, 2016 (EP) ..... 16275156

(51) Int. Cl.
*A61G 5/06* (2006.01)

(52) U.S. Cl.
CPC ..... *A61G 5/061* (2013.01); *A61G 5/066* (2013.01)

(58) Field of Classification Search
CPC ..... A61G 5/061; A61G 5/066; A61G 5/068
(Continued)

(56) References Cited

U.S. PATENT DOCUMENTS 4,132,423 A * 1/1979 Chant ..... A61G 5/06 280/5.3
4,222,449 A 9/1980 Feliz
(Continued)

FOREIGN PATENT DOCUMENTS

| | | | |
|---|---|---|---|
| JP | 62-26174 | A | 2/1987 |
| JP | H023577 | U | 1/1990 |
| WO | 2016131095 | A1 | 8/2016 |

OTHER PUBLICATIONS

International Search Report (PCT/ISA/210) dated Jan. 4, 2017, by the European Patent Office as the International Searching Authority for International Application No. PCT/EP2017/076769.
(Continued)

*Primary Examiner* — Kevin Hurley
*Assistant Examiner* — Conan D Duda
(74) *Attorney, Agent, or Firm* — Buchanan Ingersoll & Rooney PC

(57) ABSTRACT

A vehicle ramp assembly as disclosed includes a ramp for supporting one or more wheels of a vehicle and providing a bridge over stepped terrain on which the wheels of the vehicle can travel. The ramp can move among a first configuration where the ramp is stowed in the ramp assembly, a second configuration where the ramp extends from the ramp assembly, and a third configuration where the ramp is supports the vehicle wheels as it travels over stepped terrain. A drive mechanism for the ramp, and a carriage coupling the drive mechanism to the ramp enable rotation of the ramp. A secondary actuation system enables linear movement of the carriage along the ramp. A control module can drive the carriage around a curvilinear loop, such that the ramp is driven in a cycle from the first configuration to the second configuration to the third configuration to the first configuration.

20 Claims, 8 Drawing Sheets

(58) Field of Classification Search
USPC ..... 180/8.2
See application file for complete search history.

(56) References Cited

U.S. PATENT DOCUMENTS

| | | | | |
|---|---|---|---|---|
| 4,566,551 | A * | 1/1986 | Feliz | A61G 5/061 180/9.1 |
| 4,676,765 | A | 6/1987 | Mckay et al. | |
| 5,230,522 | A * | 7/1993 | Gehlsen | A61G 3/063 180/8.2 |
| 5,447,317 | A | 9/1995 | Gehlsen et al. | |
| 5,507,358 | A | 4/1996 | Abe et al. | |
| 5,579,857 | A | 12/1996 | Abe et al. | |
| 7,850,189 | B2 | 12/2010 | Barber et al. | |
| 2002/0121394 | A1 | 9/2002 | Kamen et al. | |
| 2005/0023052 | A1 | 2/2005 | Beck et al. | |
| 2007/0080001 | A1 | 4/2007 | Beck et al. | |
| 2009/0108561 | A1 | 4/2009 | Barber et al. | |
| 2014/0083788 | A1 | 3/2014 | Behrens | |
| 2015/0129328 | A1 | 5/2015 | Behrens | |
| 2018/0028380 | A1 | 2/2018 | Behrens | |

OTHER PUBLICATIONS

International Search Report (PCT/ISA/210) dated Jan. 8, 2017, by the European Patent Office as the International Searching Authority for International Application No. PCT/EP2017/076772.

Notification of Transmittal of the International Preliminary Report on Patentability (PCT/IPEA/409) dated Jan. 4, 2018, by the Patent Office as the International Preliminary Examining Authority for International Application No. PCT/EP2017/076769.

Notification of Transmittal of the International Preliminary Report on Patentability (PCT/IPEA/409) dated Jan. 8, 2017, by the Patent Office as the International Preliminary Examining Authority for International Application No. PCT/EP2017/076772.

Written Opinion (PCT/ISA/237) dated Jan. 4, 2018, by the European Patent Office as the International Searching Authority for International Application No. PCT/EP/2017/076769.

Written Opinion (PCT/ISA/237) dated Jan. 8, 2017, by the European Patent Office as the International Searching Authority for International Application No. PCT/EP2017/076772.

* cited by examiner

VEHICLE RAMP ASSEMBLY

TECHNICAL FIELD

The present invention relates to a ramp assembly for a vehicle, and particularly, but not exclusively, to a ramp assembly for a enabling a wheeled vehicle to traverse stepped terrain such as a staircase.

BACKGROUND ART

Enabling vehicles to navigate difficult terrain more effectively is a topic which has been researched both for terrestrial applications and applications in space. One concept that has been explored is the use of deployable structures to bridge gaps or traverse obstacles.

For example, many wheelchair users carry with them portable ramps which can be manually deployed to traverse small obstacles such as a single stair or a curb. However, such manual deployment can be difficult where mobility of the wheelchair user is restricted, and it is often difficult to secure the ramp in position to enable the wheelchair to pass over the ramp. In addition, retrieval of the ramp after the wheelchair has passed over it can also be difficult if there is limited room for manoeuvre of the wheelchair, coupled with the potential danger presented to the user if it is necessary to reach up or down a step to collect the ramp.

For other vehicle types, the manual deployment process can be cumbersome, particularly where multiple vehicle wheels need to be separately guided over one or more steps, and the ability to traverse particular terrain can be limited by the nature of the deployable structure which is used.

There is therefore a need for an improved mechanism for enabling vehicles to traverse particular terrain.

U.S. Pat. No. 7,850,189 discloses a portable ramp system intended to assist handicapped persons with transport in and out of houses and buildings. The system consists of a wheelchair attachment having several modular ramp members attached to one another to allow convenient access. The system requires manual deployment of the ramp, however, and as such requires the user to be physically capable of handling loads. Consequently, many users are unable to use this system. In addition, the system does not permit control over the extension of the connection arms between the wheelchair connection and the ramp, and the ramp length and associated ramp gradient limits the terrain over which the wheelchair can pass.

U.S. Pat. No. 5,447,317 discloses a lifting apparatus having two parallel base runners which attach to a wheelchair and serve as a lifting platform. The wheelchair is lifted relative to the base runners and a sliding subsystem moves the vehicle onto a particular step. The design is bulky and heavy, is limited to traversal of one or two steps, and is associated with potential balance issues.

SUMMARY OF INVENTION

Embodiments of the present invention aim to improve on the above systems by providing a mechanism which enables a vehicle to traverse one or multiple steps or any traversable object through the automated deployment and recovery of a ramp.

According to an aspect of the present invention, there is provided a ramp assembly for a vehicle, comprising a ramp for supporting one or more wheels of a vehicle and providing a bridge over stepped terrain on which the wheels of the vehicle can travel, wherein the ramp is arranged to be movable between a first configuration in which the ramp is stowed in the ramp assembly, a second configuration in which the ramp extends from the ramp assembly, and a third configuration in which the ramp is arranged to support the wheels of the vehicle as it travels over the stepped terrain, a drive mechanism for driving motion of the ramp, a carriage coupling the drive mechanism to the ramp, the carriage having a primary actuation system to enable rotation of the ramp about a pivot, and a secondary actuation system to enable linear movement of the carriage along the ramp, the apparatus further comprising a control module for controlling the drive mechanism to drive the carriage around a curvilinear loop, and to control the carriage and drive mechanism such that the ramp is driven in a cycle from the first configuration to the second configuration to the third configuration to the first configuration.

The design of the ramp assembly may be such that deployment of the ramp is automated, and occurs in a manner such that the ramp remains connected to the wheeled vehicle at all times during the deployment and recovery process, improving both convenience and safety. The ramp can be conveniently stowed for future deployment.

The drive mechanism may comprise a conveyor belt and one or more drive gears for driving the conveyer belt, wherein a portion of the carriage may be coupled to the conveyor belt such that the carriage is driven around the curvilinear loop by the one or more drive gears.

The drive mechanism may comprise a guide track arranged around the conveyor belt and configured to support the carriage as it is driven around the curvilinear loop.

The drive mechanism may comprise a rack and pinion system, in which the carriage is coupled to the pinion, and the rack on which the pinion is mounted may be a guide track arranged to support the carriage as it is driven around the curvilinear loop, where the drive mechanism may further comprise a drive means for driving the pinion along the guide track.

The ramp assembly may comprise a carriage locking mechanism for locking the position of the carriage on the curvilinear loop by locking the position of the carriage with respect to the drive mechanism.

The ramp assembly may comprise a ramp locking mechanism for locking the position of the ramp with respect to the carriage.

The ramp assembly may comprise sensing means for sensing stepped terrain, wherein the control module may be arranged to control the drive mechanism and the carriage in accordance with information received from the sensing means such that the ramp assembly enables a vehicle to travel over the stepped terrain on the ramp.

The carriage may comprise a rotary drive means for driving rotation of the ramp about a rotation axis of the rotary drive means when the carriage is positioned towards an end of the ramp, and the control means may be arranged to control the rotary drive means to control the angle of rotation of the ramp.

The ramp may be telescopic, and the control module may be arranged to control extension of the ramp in accordance with information received from the sensing means and the angle of rotation of the ramp.

The ramp may comprise two or more elongate portions, each elongate portion arranged to support a respective one or more wheels of a vehicle.

The ramp assembly may comprise a plurality of wheels, wherein the ramp assembly may be arranged in a space surrounded by the plurality of wheels.

According to another aspect of the present invention, there is provided a wheeled vehicle comprising the ramp assembly of any one of the preceding claims.

The wheeled vehicle may be a wheelchair, wherein the first configuration may be such that the ramp is positioned above the wheels of the wheelchair.

The control module may be arranged to suspend operation of the drive mechanism when ramp is in the third configuration and the wheelchair is driven over stepped terrain on the ramp, and the secondary actuation system may be arranged to be driven by the driving of the wheelchair to move the carriage from the front of the ramp to the rear of the ramp, wherein after the wheelchair has travelled over the ramp, the ramp may be arranged to extend to the rear of the wheelchair, and the control module may be arranged to reactivate control of the drive mechanism to drive the ramp to the first configuration.

The control module may be arranged to control the drive mechanism to drive the wheelchair on the ramp.

The wheeled vehicle may be a wheeled-walker, a mobility scooter, supermarket trolley, delivery equipment, pushchair, exploration rover for Earth or another planetary body. The ramp assembly has potential uses including, but not restricted to, robotic exploration vehicle for terrestrial applications such as volcano science and observation, deep sea ocean floor driving, robotic navigation in an urban environment, military applications, and healthcare applications such as mobility vehicles.

BRIEF DESCRIPTION OF DRAWINGS

Embodiments of the present invention will be described, by way of example only, with reference to the following drawings, in which.

DETAILED DESCRIPTION

Figure 1:
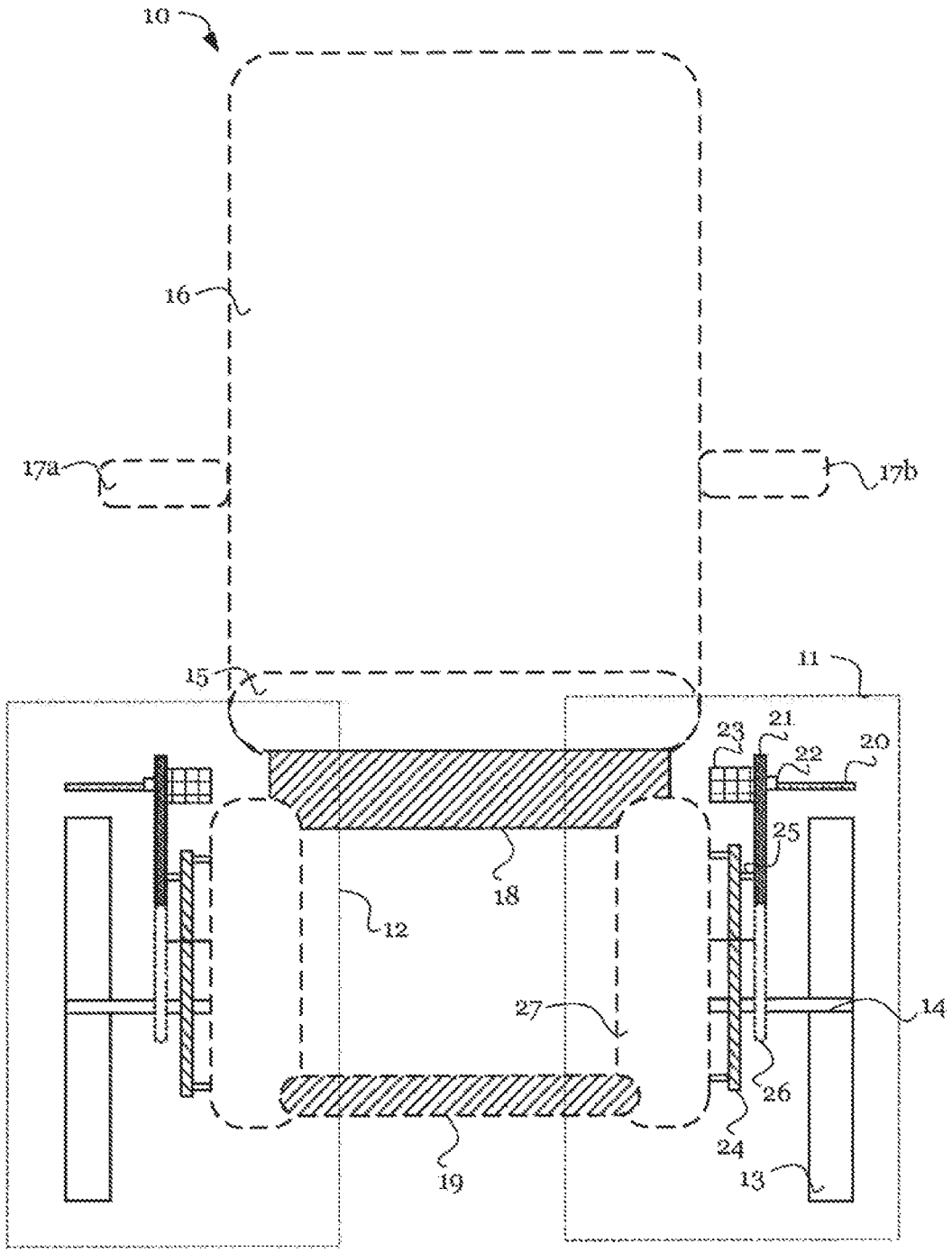
FIG. 1 illustrates a front view of a wheeled vehicle with a ramp assembly according to an embodiment of the present invention.

FIG. 1 illustrates a front view of a wheeled vehicle with a ramp assembly according to an embodiment of the present invention. In the present embodiment, the wheeled vehicle is a wheelchair 10, and two ramp assemblies 11, 12 are illustrated, a first ramp assembly 11 associated with the left-sided wheels of the wheelchair 10 (the front left wheel 13 is illustrated on the right hand side of FIG. 1, together with its axle 14), and a second ramp assembly 12 associated with the right-sided wheels of the wheelchair 10. In the following description, the first ramp assembly 11 will be described, and it will be understood that in the present embodiment, the second ramp 12 assembly is the same as the first ramp assembly 11, other than its physical orientation being reversed as illustrated in FIG. 1.

The wheelchair 10 includes a seat 15, a seat back 16, and arm rests 17*a*, 17*b* for accommodating a user. The seat 15, seat back 16, and arm rests 17*a*, 17*b* are fixed to a chassis 18, a portion of which is illustrated in FIG. 1. The wheel axle 14 is also coupled to the chassis 18. The wheelchair 10 also comprises a footrest 19.

The ramp assembly 11 contains a ramp 20, a frontal cross-section of which is illustrated in FIG. 1. In the following description, the term "ramp" shall be used to denote a structure which is used to bridge the gap between two obstacles, or to level uneven ground or terrain. The ramp 20 can be a single rigid structure, or can be comprised of a plurality of sub-structures or sub-ramps. The ramp may be based on a plastic (such as carbon fibre reinforced plastic (CRFP), glass fibre reinforced plastic (GFRP), metal or wooden board or plank or other suitable material, and contains portions which are rubberised or otherwise adapted to be suitable for providing a frictional coupling with the wheels which are intended to pass over the ramp. It will thus be appreciated that different ramp configurations are possible depending on the particular vehicle to which the ramp assembly is intended to be fitted.

In the arrangement illustrated in FIG. 1, the ramp is in a "stowed" configuration, in which it is not in a position to support wheels of the wheelchair 10, but is accommodated in or adjacent to the chassis 18 of the wheelchair 10 in a convenient manner to enable movement of the wheelchair 10 over substantially smooth terrain.

As will be described in more detail below, the purpose of the ramp 20 is to provide a surface over which at least the left-sided wheels can travel in order to traverse uneven terrain. The ramp assembly 11 contains components which control and drive the position of the ramp 20 to achieve this particular result.

In the present embodiment, the ramp 20 is coupled to a carriage 21 via a coupling interface 22 containing bearings or the like. The carriage 21 supports the ramp 20 such that relative movement of the ramp 20 and the carriage 21 is possible in a linear direction, and such that the ramp 20 can pivot about the carriage 21. The carriage 21 is illustrated in FIG. 1 as having actuation system 23 which enables the linear and pivoting motion. The actuation system 23 has a primary actuation system for enabling linear motion, and a secondary actuation system for enabling pivoting motion, although it is possible for the primary and secondary actuation systems to be integrated.

The carriage 21 is coupled to a closed-loop guide track 24 via a coupling interface 25 containing bearings or the like. The guide track 24 is arranged around a conveyor belt 26. Frontal cross-sections of the guide track and the conveyor belt are illustrated in FIG. 1.

The conveyor belt 26 is arranged such that it provides a mechanism for causing the carriage 21 to move on the guide track 24, and in this regard, the shape of the guide track 24 corresponds to that of the conveyor belt 26, as will be described in more detail below. Driving of the carriage 21 on the guide track 24 enables the position of the ramp to be moved with respect to the wheelchair 10.

The ramp assembly 11 comprises a control module 27 which houses control circuitry and drive electronics. The control module 27 is coupled to the chassis 18 of the wheelchair 10, and provides control of the actuation system 23 and the conveyor belt 26. The control module 27 may provide physical support to the guide track 24, although the guide track 24 may in other embodiments be coupled to the chassis 18 instead.

The ramp assembly 11 may be a separable component from the wheelchair 10, but in other embodiments, may be an integral part of the wheelchair. In FIG. 1, the wheel 13 and the wheel axle 14 are illustrated as part of the ramp assembly but in other embodiments, the wheel 13 and wheel axle 14 need not be part of the ramp assembly 11, and the wheels may be part of the conventional design of the wheelchair body, so that the ramp assembly 11 contains only the drive mechanisms for the ramp 20 and carriage 21, and the control module 27, and the ramp assembly 11 can be fitted to an otherwise conventional wheelchair.

Although two ramp assemblies 11, 12 are illustrated in the embodiment of FIG. 1, modifications of this configuration are possible in other embodiments, depending on the particular configuration of the vehicle. For example, whereas some vehicles comprise four wheels, other vehicles may comprise two or three wheels, or five or more wheels, and the layout of the ramp assemblies is configured such that wheels can be supported by a ramp. For example, where the lateral position, relative to the chassis, of the wheels differs, the number of ramp assemblies may be selected so as to correspond to the number of different lateral wheel positions. For a three-wheeled vehicle, for example, where the wheels are arranged with two lateral rear wheels and a single central front wheel, three ramp assemblies may be required to provide ramps at the left and right positions and the central positions relative to the chassis. In other embodiments, a single ramp assembly and a single ramp may be used to support the wheels of the vehicle.

Although FIG. 1 illustrates a control module for each ramp assembly, it is possible to use a single master control module for multiple ramp assemblies, to provide parallel drive control signals to multiple ramp carriages and conveyor belts. In addition, additional control circuitry to that contained in the control module 27 may be included in the actuation system 23 and operated in parallel with, or in a master/slave arrangement with the control module 27.

Figure 2:
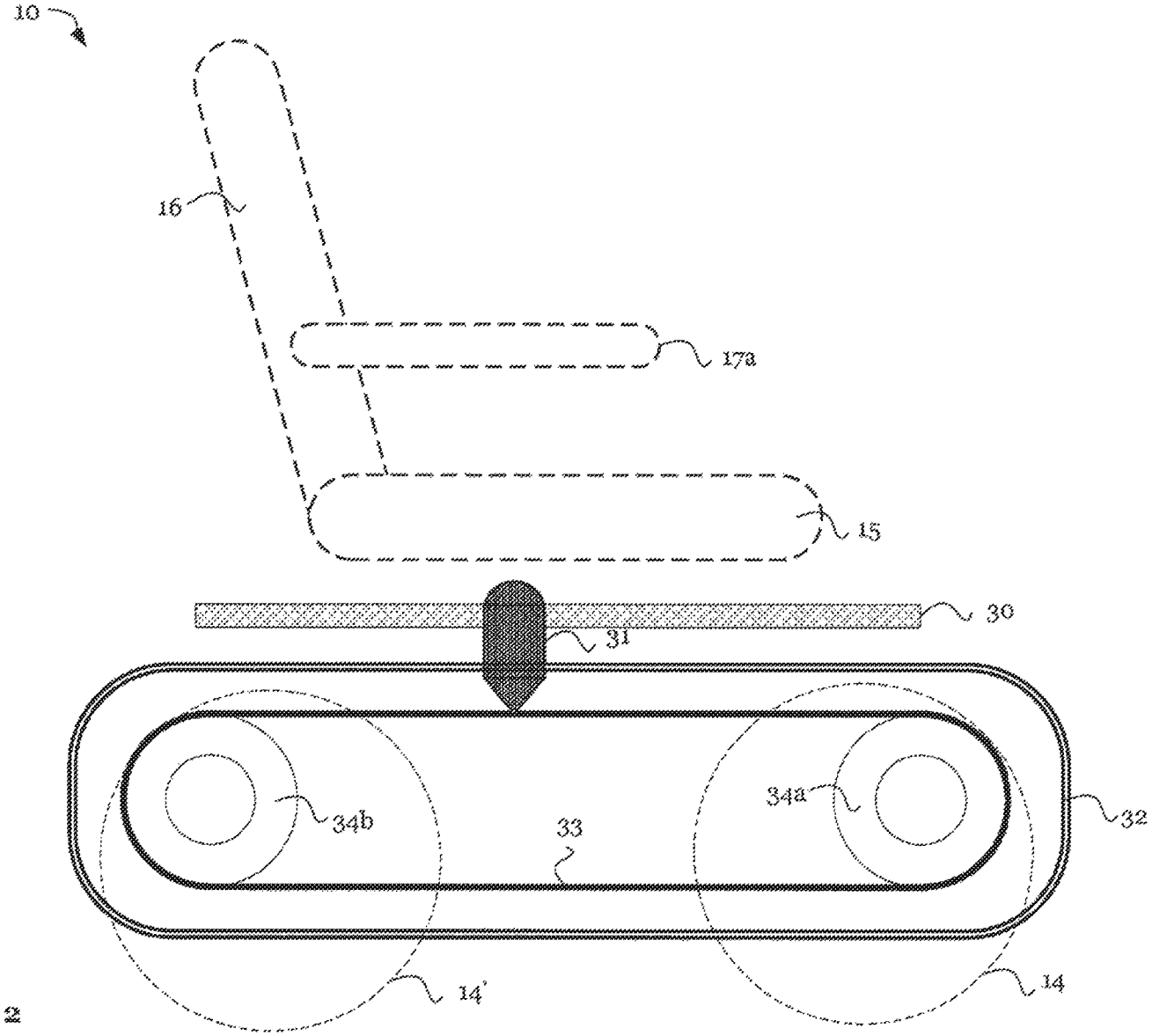
FIG. 2 illustrates a side view of the wheeled vehicle of the embodiment of FIG. 1.

FIG. 2 illustrates a side-view of the wheelchair 10 of the embodiment of FIG. 1. The side profile of the seat 15, seat back 16 and right arm rest 17*a* is shown, although the chassis 18 is omitted. Right-sided wheels are illustrated 14, 14'. Components of the right-side ramp assembly 12 are also illustrated, namely a ramp 30, carriage 31, guide track 32, and conveyor belt 33, which are respectively configured in the manner described with respect to ramp 20, carriage 21, guide track 24 and conveyor belt 26 of the left-side ramp assembly 11 described with reference to FIG. 1. The conveyor belt 33 is driven by drive gears 34*a*, 34*b*. The drive gears 34*a*, 34*b* and carriage 31 are driven by a control module (not shown) equivalent to the control module 27 illustrated in FIG. 1. In the present embodiment, both drive gears 34*a* and 34*b* may be powered, but in other embodiments it would be possible for only one gear to be powered, while the other gear can freewheel. Additional gears may be arranged at intermediate positions along the conveyor belt. The powered drive gears are such that the gears do not freewheel when no driving power is imparted to the gears. The drive gears 34*a*, 34*b* may be powered by one or more rotary drive mechanisms, servo-motors, stepper motors, DC motors or the like.

The stowed configuration of the ramp 30 is illustrated in FIG. 2 as being a position above the wheels 14, 14' of the wheelchair 10, although modifications of this position are possible as will be described below. The carriage 31 is movable to the left and right such that it can be driven to slide along the ramp 30 in a linear direction when driven by the conveyor belt 33 which is in turn driven by the drive gears 34*a*, 34*b*. When the carriage 31 is driven by the conveyor belt 33, it is supported on the guide track 32. The guide track 32 has a shape which corresponds to the conveyor belt 33, and supports the carriage 31 at a predetermined spacing from the conveyor belt 33.

The combination of the conveyor belt 33 and associated drive gears 34*a*, 34*b*, and the guide track 32 will be referred to herein as a drive mechanism for the carriage 31, since these components enable movement of the carriage 31 relative to the chassis 18 of the wheelchair 10. The drive mechanism is controlled by a control module (not shown), and the operation of the control module and the shape of the components of the drive mechanism are such that the carriage 31, and particularly at least one point of coupling of the carriage 31 to the drive mechanism, is movable, relative to the chassis 18 of the wheelchair 10 around a substantially curvilinear loop. In the present embodiment, the curvilinear loop follows the shape of the guide track. Since the carriage 31 can move around the curvilinear loop, it is also possible for the ramp 30 to be moved around the curvilinear loop.

Figure 3:
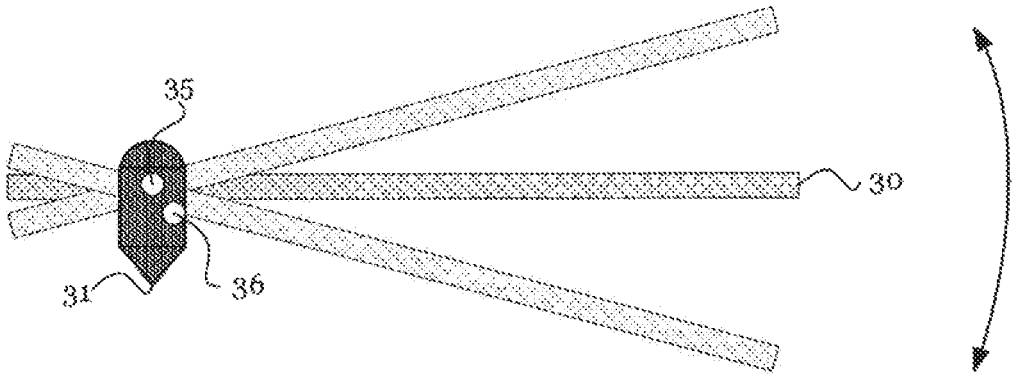
FIG. 3 illustrates the pivoting of the ramp about a carriage according to embodiments of the present invention.
Figure 4:
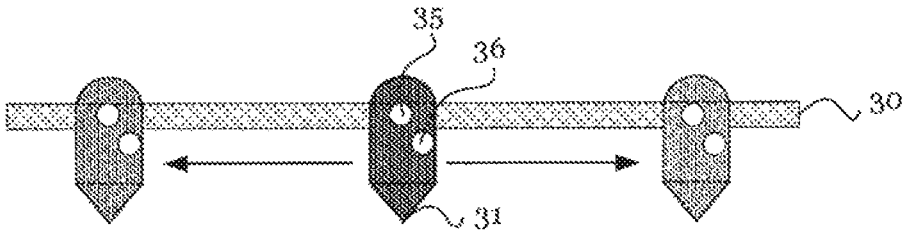
FIG. 4 illustrates the sliding of the carriage relative to the ramp according to embodiments of the present invention.

FIGS. 3 and 4 are illustrate the relative movement which is possible between the ramp and the carriage 31 in isolation from other components of the ramp assembly of embodiments of the present invention. As described above, the carriage 31 may comprise an actuation system equivalent to the actuation system 23 of FIG. 1, which comprises a primary actuation system 36 and a secondary actuation system 35. Secondary actuation system 35 enables pivoting of the ramp 30 about the carriage 31 and uses a servo-motor to drive the ramp 30 relative to the carriage 31 so that its angle, relative to a particular reference plane, can be adjusted as shown in FIG. 3. Primary actuation system 36 enables linear motion of the carriage 31 relative to the ramp 30 about the connection point between the carriage 31 and the ramp 30, as illustrated in FIG. 4. The primary actuation system 36 may comprise a servo-motor. The ramp 30 may comprise a slider or grooved track (not shown) which facilitates linear motion of the carriage 31 along the ramp 30, or linear motion of the ramp 30 through the carriage 31. As alternatives to the servo-motors of the primary and secondary actuation systems, rotary drive systems such as stepper motors or DC motors, or linear actuators may be used. For convenience of illustration, the actuation systems 35, 36 are omitted from subsequent Figures showing the carriage 31.

Figure 5:
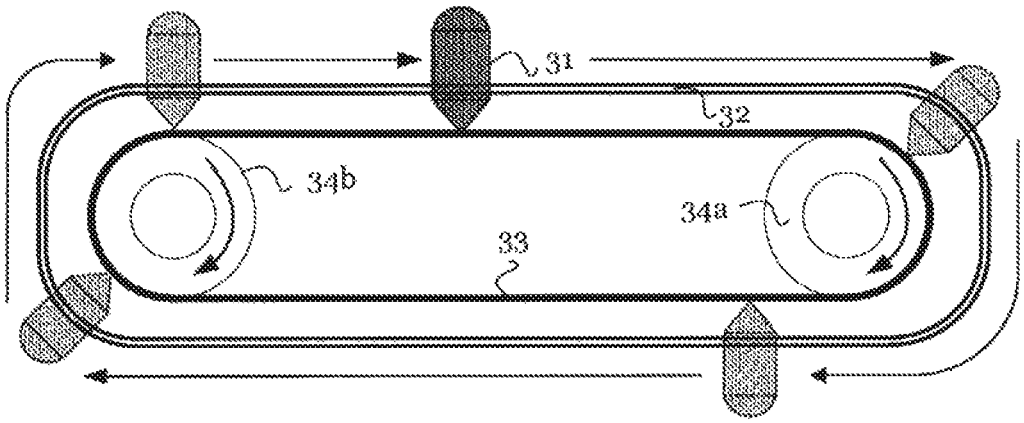
FIG. 5 illustrates movement of the carriage around a curvilinear track according to embodiments of the present invention.

Having defined the relative motion which is possible between the ramp 30 and the carriage 31, the motion of the carriage 31 with respect to the curvilinear loop will be described with reference to FIG. 5, which illustrates the carriage 31, the guide track 32, the conveyor belt 33 and the drive gears 34*a*, 34*b* in isolation from the wheelchair.

The drive gears 34*a*, 34*b* are illustrated as rotating in clockwise direction, causing the conveyor belt 33 to similarly rotate to the clockwise direction. Since the carriage 31 is coupled to the conveyor belt 33, the point of coupling of the carriage 31 to the conveyor belt, and thus the carriage 31 as a whole, is moved, relative to the chassis of the wheelchair, around a curvilinear loop in a clockwise direction, as supported by the guide track 32.

It is of course equally possible for the drive gears 34*a*, 34*b* to rotate in an anti-clockwise direction such that the carriage 31 moves around the curvilinear loop in an anti-clockwise direction, and the direction of movement can be selected by the control module of the ramp assembly in dependence on the orientation of the ramp assembly when coupled to the vehicle, the direction of travel and the nature of the stepped terrain. Since the curvilinear loop is a closed-loop system, one full revolution of the conveyor belt 33 enables one full revolution of the carriage 31 around the guide track 32 to return to its "home" position, illustrated in darker shading in FIG. 5.

Coupling of the carriage 31 to the conveyor belt 33 is achieved by a clamp, docking mount or other fixing mechanism which provides sufficient flexibility in the point or points of coupling of the carriage 31 to enable the carriage 31 to move around the curved sections of the curvilinear loop, as it will be appreciated that the conveyor belt 33 will need to stretch slightly when curving, and to compress slightly when returning to linear motion. The conveyor belt 33 can be constructed using rubber or any other suitable material to which a tension can be applied which is such that it can be driven by the rotation of the gears 34*a*, 34*b*, and can transmit the rotational drive of the gears 34*a*, 34*b* into drive of the carriage 31. In alternative embodiments, the belt can take the form of a chain, coupled to the teeth of the gears 34*a*, 34*b*, or a cable such as a steel cable.

The carriage 31 may be coupled to the guide track 32 via a bearing interface, which enables the carriage 31 to move smoothly along the guide track 32 on the bearings of the interface. The guide track 32 may thus comprise bearings which correspond to bearings on the carriage 31, and the guide track 32 comprises a guide rail (not shown) which prevents perpendicular motion of the carriage 31 with respect to the direction of the guide track 32. This rail provides auxiliary support to the weight of the carriage 31 in addition to the primary support provided by the coupling of the carriage 31 to the conveyor belt 33. In this manner, the carriage 31 is fixed to the drive mechanism of the ramp assembly. The guide track 32 may be formed of any suitable material such as plastic or metal.

Through the drive power which is provided by the gear wheels 34*a*, 34*b*, and the freedom of movement of the carriage 31 relative to the ramp 30 shown in FIGS. 3 and 4, it is possible to effect motion of the ramp 30 between a series of different positions as will be described below with reference to FIGS. 6-12, such that the ramp 30 enables the wheels of the vehicle to traverse stepped terrain, and such that the ramp 30 can be stowed when not in use. FIGS. 6-12 are illustrated with respect to the wheelchair 10 of FIGS. 1 and 2. In each of the figures, directions of motion are illustrated by dotted arrows.

Figure 6:
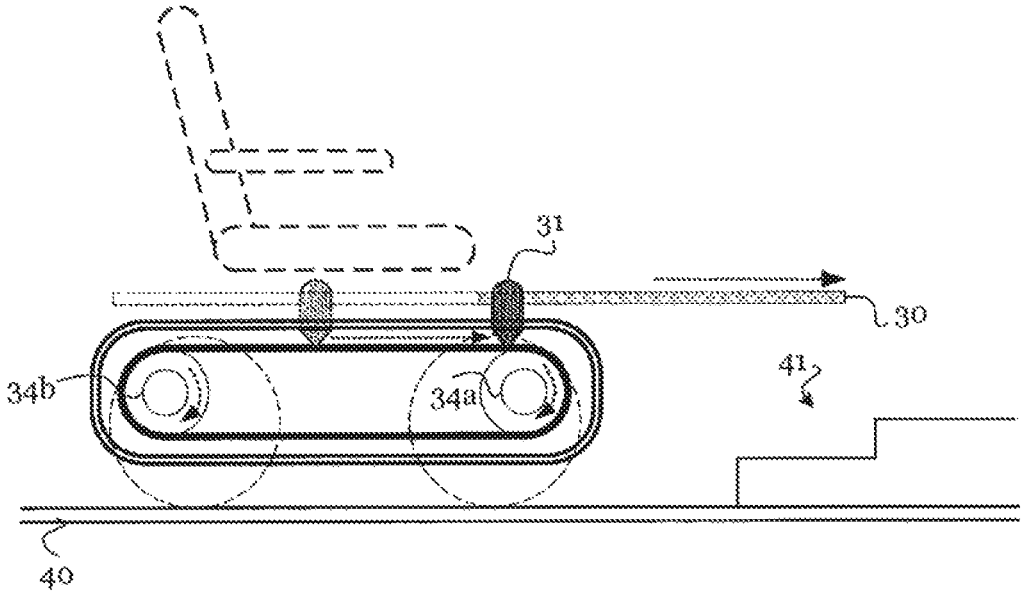
FIGS. 6 to 12 illustrate a sequence of deploying a ramp according to an embodiment of the present invention.

FIG. 6 illustrates a wheelchair at the start of the ramp deployment process according to an embodiment of the present invention. The wheelchair is on flat or smooth terrain 40, and is approaching stepped terrain 41. It is determined that the wheelchair is approaching a step, either manually, by a user of the wheelchair, or automatically, by sensors such as optical (such as camera vision systems) infrared or ultrasonic range sensors mounted to the wheelchair which perform edge detection or the like. Having determined that there is stepped terrain 41 ahead, the control module (not shown) of the ramp assembly causes the drive gears 34*a*, 34*b* to rotate in the clockwise direction such that the carriage 31 moves forward to a position at the front of the curvilinear loop, from left to right as shown in FIG. 6, in the manner described with respect to FIG. 5. In the embodiment of FIG. 6, the carriage 31 is arranged so that it remains on a linear portion of the curvilinear loop, rather than a curved portion, although in modifications of this embodiment, the carriage 31 could move into the curved zone of the loop.

Either simultaneously with the movement of the carriage 31 to the deployment configuration, or in sequence with this movement, or in a sequence which at least partially overlaps with the movement of the carriage 31 to the deployment configuration, the ramp 30 is deployed in a forwards direction relative to the wheelchair, towards the stepped terrain 41. This is achieved by effecting linear motion of the ramp 30 relative to the carriage 31, via the primary actuation system 36, as illustrated with reference to FIG. 4. In the present embodiment, the ramp 30 is fully deployed and the ramp 30 will be referred herein to as in the "deployment configuration" in this arrangement.

Figure 7:
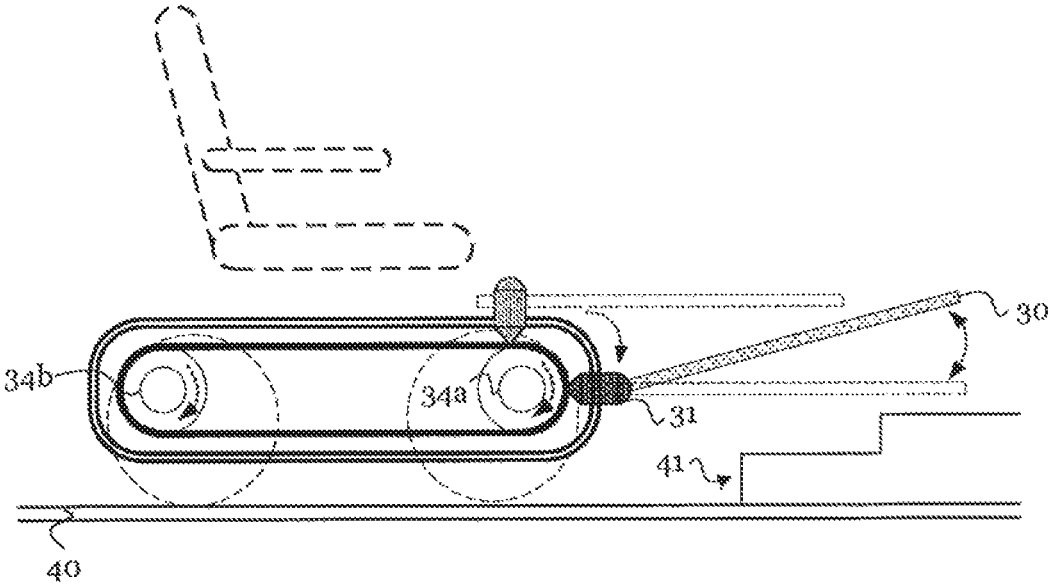
Figure 8:
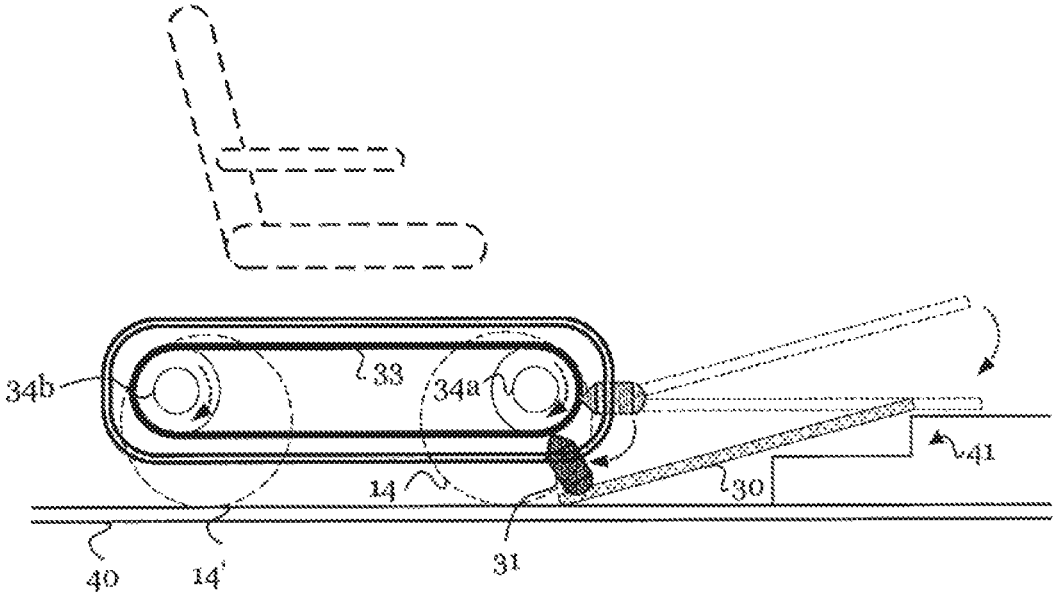

The next stage in the deployment sequence according to the present embodiment is illustrated with respect to FIG. 7, which illustrates preparation for docking. The drive gears 34*a*, 34*b* are further rotated in the clockwise direction which causes the carriage 31 to move into the curved portion of the curvilinear loop at the front of the loop. The secondary actuation system 35 operates to enable pivoting of the ramp 30 about the carriage 31 in this step of the deployment sequence. As the carriage 31 initially moves around the curvilinear loop, the angle of the ramp 30 relative to the carriage 31 is adjusted to avoid the ramp 30 being directed downwards into the terrain 40, 41. In the present embodiment, the secondary actuation system 35 operates to maintain the ramp in an orientation substantially parallel with the ground 40 until the carriage 31 has come to rest in its final position of this step of the sequence. The secondary actuation system 35 then causes further pivoting of the ramp 30 in anticipation of the "docking" configuration of the ramp 30 to be adopted as shown in FIG. 8. The operation of the secondary actuation system 35 may be modified, however, such that pivoting of the ramp 30 occurs when the carriage 31 is in the position shown in FIG. 6, in advance of movement of the carriage 31. Alternatively, pivoting of the ramp 30 and movement of the carriage 31 may occur simultaneously or parts of the pivoting of the ramp 30 and movement of the carriage 31 may occur simultaneously.

FIG. 8 illustrates the docking configuration of the ramp 30 in the deployment sequence of the present invention. The drive gears 34*a*, 34*b* are further rotated in the clockwise direction which causes the carriage 31 to move around the curved portion of the curvilinear loop at the front of the wheelchair until the carriage 31 approaches the next linear section of the loop on the underside of the conveyor belt 33. As described with reference to FIG. 7, pivoting of the ramp 30 with respect to the carriage 31 occurs in a manner which enables movement of the ramp 30 as the carriage 31 moves, and which causes the ramp 30 to reach its docking configuration.

Specifically, the carriage 31 and ramp 30 are positioned such that the underside of the ramp 30 makes contact with the highest portion of the step 41. Then, the ramp 30 is lowered to the docking configuration by movement of the carriage 31 to the underside of the conveyor belt 33, which pulls the ramp 30 backwards and downwards into position so that it locks between the edge of the step 41 and the ground 40 as shown in FIG. 8. At this point, the ramp 30 is docked with respect to the ground 40, and arranged such that the wheels 14, 14' of the wheelchair can move onto the ramp 30.

Figure 9:
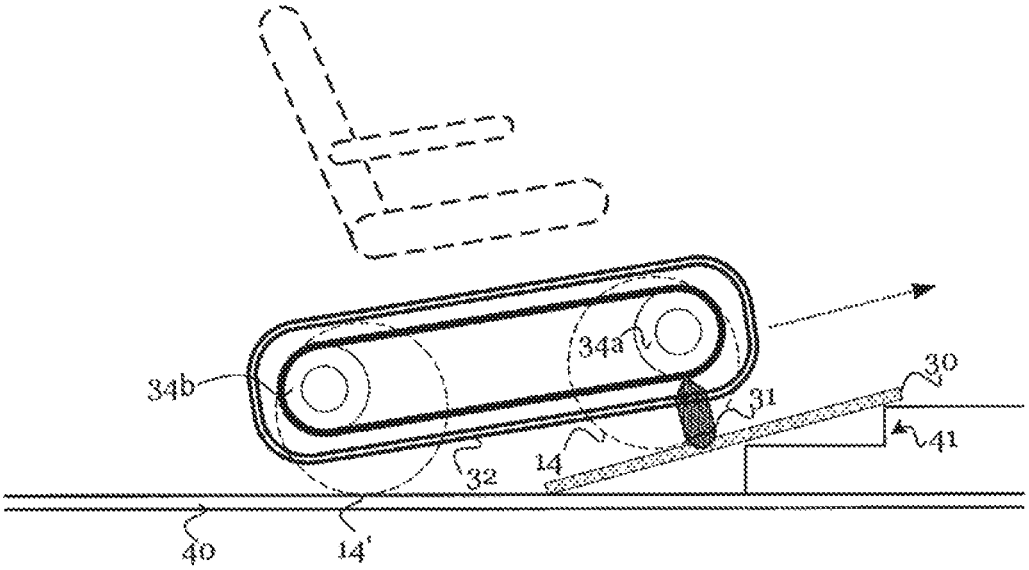

Once the ramp 30 is secured in place, the front wheels 14 of the wheelchair mount the ramp 30 as shown in FIG. 9. The mounting may be performed using manual drive of the wheels of the wheelchair by the user, or by using powered wheels. During this manoeuvre, the carriage 31 is maintained in a locked position with respect to the guide track 32, in line with the front wheel 14, but free to slide linearly with respect to the ramp 30 as the wheelchair moves. Consequently, in this configuration, linear motion between the ramp 30 and the carriage 31 may be driven by the power of the wheelchair but in a modification of this embodiment, the primary actuation system 36 may also assist in driving linear motion of the ramp 30 relative to the carriage 31.

The locking of the carriage 31 with respect to the guide track 32 may be performed by deactivating the drive gears 34*a*, 34*b* and locking them in position using a carriage lock or brake or the like (not shown).

Figure 10:
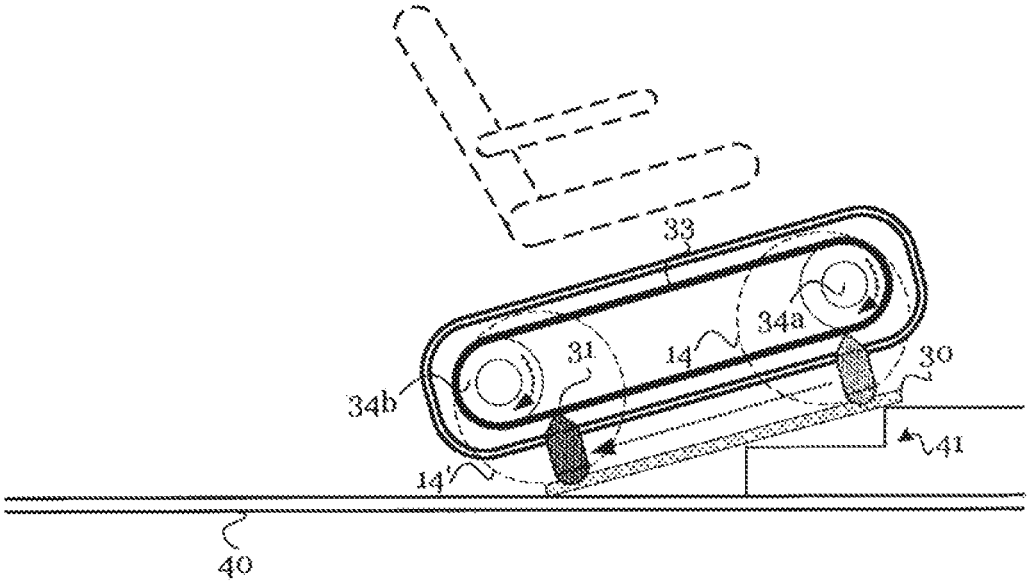

As the front wheels 14 of the wheelchair move onto the ramp 30, the rear wheels 14' of the wheelchair reach the front of the ramp 30, and both front and rear wheels 14, 14' are supported by the ramp 30, which remains in the docked configuration relative to the terrain 40, as shown in FIG. 10.

Once both the front and rear wheels 14, 14' are on the ramp 30, the wheelchair pauses on the ramp while the drive gears 34*a*, 34*b* are activated in the clockwise direction to move the carriage 31 rearwards along the curvilinear loop, towards the rear of the ramp 30. The carriage 31 stops when it reaches a position towards the end of the linear section of the loop, towards the rear of the wheelchair. Once the carriage 31 has reached this position, the wheelchair is driven forward up the ramp, traversing the step 41, until both front and rear wheels 14, 14' are on the step 41. During this process, the drive gears 34*a*, 34*b* and conveyor belt 33 and are locked so that the carriage 31 is locked on the curvilinear loop. The carriage 31 is left free to slide relative to the ramp 30, however, so that the carriage 31 can slide towards the front of the ramp 30 with the movement of the wheelchair. As in the case of the motion illustrated with reference to FIG. 9, the carriage 31 is driven relative to the ramp 30 by the motion of the wheelchair but it is possible for the primary actuation system 36 to assist in driving the carriage 31 relative to the ramp 30. As the wheelchair completes its dismount process on reaching the top of the ramp 30, its orientation may change from following the incline of the ramp 30 to adopting a flat orientation on the top of the step 41. The ramp may be pivoted on the carriage 31 by the secondary actuation system 35 in order to facilitate relative rotation of the wheelchair and the ramp 30, and it may be the case that an adjustment is made to the position of the carriage 31 by the primary actuation system 36 in order to enable the wheelchair to dismount the ramp 30 safely, avoiding rocking of the ramp 30 as the wheelchair moves from the incline of the ramp 30 to the step 41.

Figure 11:
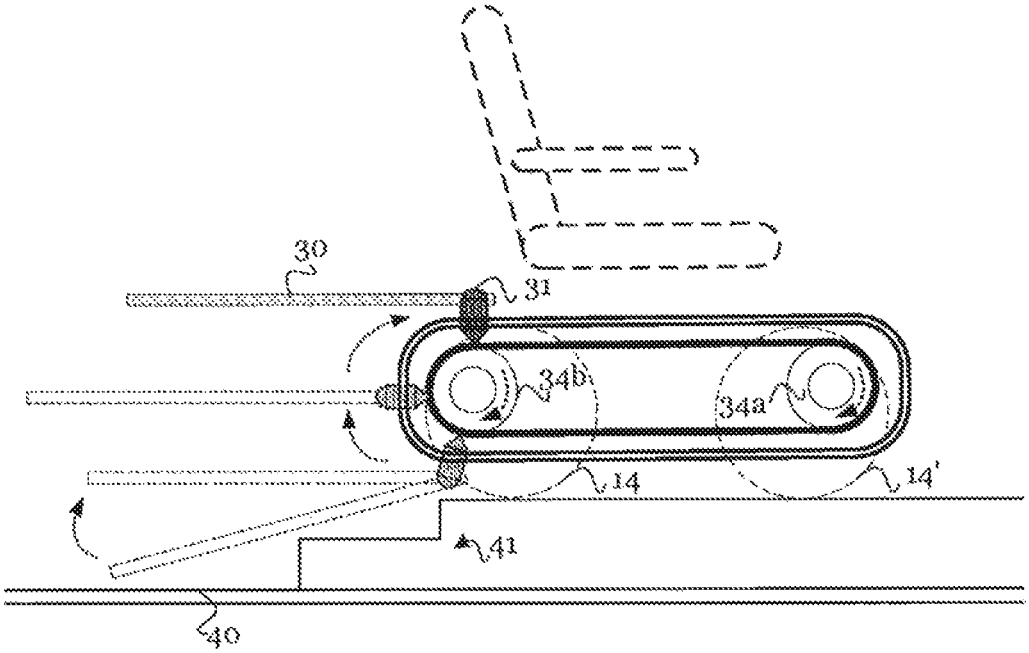

FIG. 11 illustrates the ramp recovery process according to the present embodiment. In FIG. 11, the wheelchair is illustrated as if it has completed the traverse of the step 41, and is arranged with both front and rear wheels 14, 14' on the top step 41. By virtue of the motion of the wheelchair, and the relative motion of the carriage 31 and the ramp as described with reference to FIG. 10, the ramp 30 protrudes to the rear of the wheelchair, still in the docked configuration. The secondary actuation system 35 is used to pivot the ramp 30 about the carriage 31 so that it is substantially parallel to the ground 40. The drive gears 34*a*, 34*b* are activated to drive the carriage 31 further around the curvilinear loop in the clockwise direction, and the secondary actuation system 35 pivots the ramp 30 to maintain its orientation substantially parallel to the ground 40 until the carriage 31 passes through the curved zone of the curvilinear loop and reaches the linear section above the drive gears 34*a*, 34*b*.

As described in relation to the motion of the ramp illustrated in FIG. 7, the pivoting of the ramp 30 with respect to the carriage 31 and the position of the carriage 31 may be controlled in variations of the above-described sequence, such that movement of the carriage 31 occurs prior to the pivoting of the ramp 30, simultaneously with, or partially simultaneously with the pivoting of the ramp 30.

Figure 12:
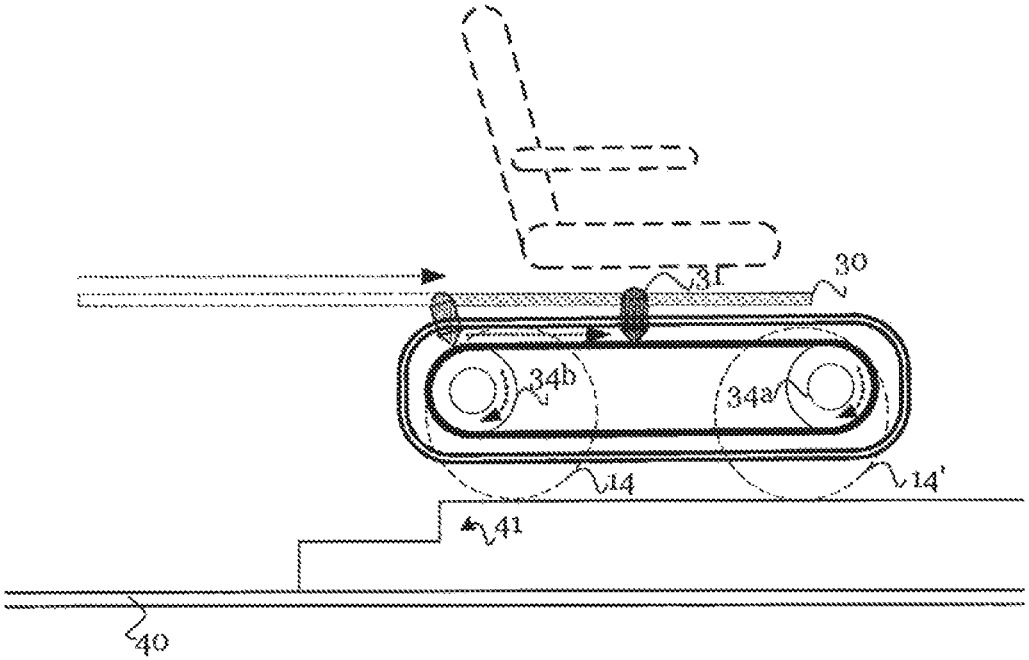

The final part of the ramp recovery process is illustrated with reference to FIG. 12, which illustrates the linear retraction of the ramp 30 into the stowed configuration by the action of the primary actuation system 36, providing linear motion between the carriage 31 and the ramp 30, and using clockwise rotation of the drive gears 34*a*, 34*b* to move the carriage 31 forward around the curvilinear loop to the home position. At the completion of the deployment sequence, the carriage 31 has completed a single revolution of the curvilinear loop.

From the stowed configuration, another step can be climbed through repetition of the steps described with reference to FIGS. 6 to 12. It will also be appreciated that the descent of a step can be performed by an analogous process as described above, with a consequential modification of the position of the ramp in order to travel from the stowed position to the docked position. Descent can be carried out in the forwards direction, in which case when moving from left to right with respect to the orientation of FIGS. 6 to 12, the drive gears 34*a*, 34*b* are driven in the clockwise direction, or in the rearwards direction, in which case when moving from right to left with respect to the orientation of FIGS. 6 to 12, the drive gears 34*a*, 34*b* are driven in the anticlockwise direction such that the direction of travel of the carriage 31 is reversed.

The operation of the control module, with regard to controlling the drive mechanism for the ramp, can be summarised by actuations of moving the ramp 30 from a first configuration in which the ramp 30 is stowed in the ramp assembly, to a second configuration, in which the ramp extends or protrudes from the ramp assembly (referred to as the deployed configuration), to a third configuration in which the ramp supports the wheels 14, 14' of the wheelchair (referred to as the docked configuration), to the first configuration again. The term 'configuration' will be understood as referring to a range of specific ramp positions, defined both with respect to the ground and the ramp assembly, in the manner described above.

It will be appreciated that a number of modifications to the above-described sequence are possible.

For example, it is possible to automate the entire sequence, via appropriate design of the control module, to occur as a continuous sequence of steps. Alternatively, the control module may be configured such that a number of steps may require prompting from a user before a subsequent step can occur. In further modifications, the user may be provided with the ability to repeat, reverse, or pause particular aspects of the deployment sequence in order to correct any positioning errors which might occur. This feature might be appropriate in order to ensure that balance of the wheelchair is maintained, or in order to account for changing terrain, which could be caused by introduction of foreign objects, or the collapse or modification of the profile of the terrain under the weight of the wheelchair or ramp.

The modification of the control module may take the form of appropriate programming of a series of instructions into a microcontroller which are executed by a processor of the microcontroller to generate drive signals for activating the drive gears and the primary and secondary actuation systems for the carriage through, for example, provision of logic high or low signals to activate switches in drive signal generation circuitry. The control module is powered by a power source such as primary or secondary battery. In alternative embodiments, the control module may be programmed in hardware, and in further embodiments, the control module may be programmed in a combination of hardware and/or software. The control module may comprise an interface such as a Universal Serial Bus (USB) socket or variants thereof, or I2C, RS232, CAN data buses or the like, wireless communication links such as WiFi, Bluetooth, to enable programming or updating of the software of the control module. The control module may comprise a user interface to provide status or diagnostic information to a user, or to enable the control of the steps of the deployment sequence as described above.

The embodiment of FIGS. 1 to 12 is described with reference to a wheelchair. It will be appreciated that various aspects of the wheelchair which are not directly associated with the ramp assembly may be varied, such as the presence or absence of the footrest 19, seat back 16 or armrests 17*a*, 17*b*.

Moreover, it will be appreciated that the wheeled vehicle need not be a wheelchair and may be a wheeled-walker, a mobility scooter, supermarket trolley, delivery equipment, pushchair, or exploration rover for Earth or another planetary body, and it will be appreciated that the ramp assemblies of the present invention are compatible with yet further vehicle types not described herein, as long as the ramps of the ramp assemblies can support the wheels to enable the vehicle to traverse stepped terrain. The wheels may be of any type suitable for enabling motion of a vehicle, such as disc-shaped wheels or tyres, balls or casters, or rollers.

In the case where the vehicle is a motorised vehicle, such as a mobility scooter, the control system for the vehicle may be integrated with the control module of the ramp assembly to enable sharing of user interface devices such as joysticks, electrical switches, and power sources.

In the sequences described above, the starting and ending positions of the carriage 31 with respect to the curvilinear loop may be predetermined, with pivoting and sliding of the ramp 30 with respect to the carriage 31 being varied in order to accommodate particular terrain. It may be determined that the carriage 31 has reached a particular starting or ending position through use of rotational sensors, rotary encoders on the drive gears 34*a*, 34*b* or the carriage 31 such that the position of the carriage can be determined and controlled by the control module. For example, where the drive gears 34*a*, 34*b* use stepper motors, the angle of the rotation of the stepper motors can be determined in accordance with a target position of the carriage 31, based on dimensions of the conveyor belt 33, guide track 32 and drive gears 34*a*, 34*b*, which are known to the control module. Potentiometers may also be used as alternatives to the rotary encoders, as will be understood by those skilled in the art.

In some embodiments, the ramp of the ramp assembly may be fitted with particular structures to facilitate gripping of terrain, such as gripping projections at the ends of the ramp 30 or on the underside of the ramp. In addition, rubber protrusions may also be used to prevent slippage.

Although the ramp has been described above as a rigid structure, it is possible in alternative embodiments for the ramp to have a degree of flexibility. For example, the ramp could be telescopic such that its extension and pivoting angle can be controlled to facilitate bridging of stepped terrain, potentially reducing the requirements on the position of the vehicle prior to a ramp deployment sequence. In addition, a longer extension of the ramp may facilitate traversal of the stepped terrain by lowering the angle of incline through which the vehicle is required to travel. A retractable ramp may also facilitate movement of the ramp as the carriage moves around the curvilinear loop through enabling the ramp to be accommodated in the ramp assembly more easily, making the ramp deployment and recovery process more efficient, and widening the range of possible stowed configurations. For example, if the ramp is retracted when in its stowed configuration above, or between the wheels of the vehicle, it could enable the entire ramp assembly to be moved relative to the vehicle, for example, contracting towards the vehicle chassis, to facilitate movement of the vehicle when the ramp assembly is not in use. In addition, the ability to change the length of the ramp as it travels may permit the use of modifications of the curvilinear loop to include additional curved or linear sections which may in turn enable the coupling of the ramp assembly to the vehicle to be modified. Control of the length of the ramp may be performed by a local control module at the carriage or by the main control module of the ramp assembly.

The stowed configuration of the ramp 30 may be modified in alternative embodiments of the present invention. For example, the ramp 30 may be positioned above, or level with the seat of a vehicle, or above or level with the top of the vehicle wheels, or can be surrounded by wheels. The specific position will depend on the application, the structure of the vehicle, and wheels, rollers or casters, the spatial constraints on the undercarriage of the vehicle, such as the required ground clearance, the size of the ramp relative to the vehicle, the structure and number of sections of the ramp, and so on. The stowed configuration is a position or positions in which the ramp 30 does not inhibit the motion of the vehicle when not travelling on smooth or even terrain.

It is described above that the deployment sequence may be initiated by the detection of a step or edge by a sensor. The control module may be such that it is able to learn new terrain to enable it to recognise that terrain in the future, by building up and storing locally a profile of known terrain profiles and geographic locations, for example. This would be particularly advantageous in cases where the vehicle is intended for repeated use in a relatively small number of locations, or where deployment sequences are to be repeated such that the vehicle can traverse a series of stairs in a staircase, for example. In this latter example, it may be that the drive mechanism may be able to drive the ramp from a stowed configuration into the next deployment configuration in a continuous sequence of movement of the ramp.

The drive mechanism above has been described with reference to the guide track 32, conveyor belt 33 and drive gears 34*a*, 34*b*. However, alternative configurations of the drive mechanism are possible in further embodiments. In one further embodiment, the belt drive system may be removed and motion of the carriage on the curvilinear guide track may be achieved through use of a rack and pinion system, where the rack is a feature of the curvilinear guide track and the pinion is mounted on the carriage and driven by an actuation system. As in the embodiments described above, the point or points of coupling of the carriage to the drive mechanism moves around a curvilinear loop relative to the vehicle chassis. In alternative embodiments, planetary gear systems or spur and bevel gears could be used. In further alternative embodiments, guide track could be removed and the closed-loop cycle of the ramp could be based purely on a connection of the carriage to the conveyor belt drive system.

As described above, the vehicle may use powered wheels to traverse the ramp once the ramp is secured in place on the stepped terrain. This design relies on the ramp-to-wheel traction in order to enable the wheels to traverse the ramp. In alternative embodiments, locomotion of the vehicle is achieved via the conveyor belt drive system. This is made possible by locking the position of the carriage with respect to the ramp at the beginning of the traverse sequence illustrated in FIG. 8, and then using the conveyor belt drive system to pull the vehicle up the ramp, or to control descent of the vehicle down the ramp. This design potentially enables steeper gradient traverse. In such embodiments, the ramp locking mechanism is provided in the carriage, controlled by the control module, and may comprise a brake or the like which prevents relative movement of the carriage and the ramp, but enables the carriage to move around the curvilinear loop. In alternative embodiments, the ramp locking mechanism may be integral to the primary and/or secondary actuation systems.

Figure 13:
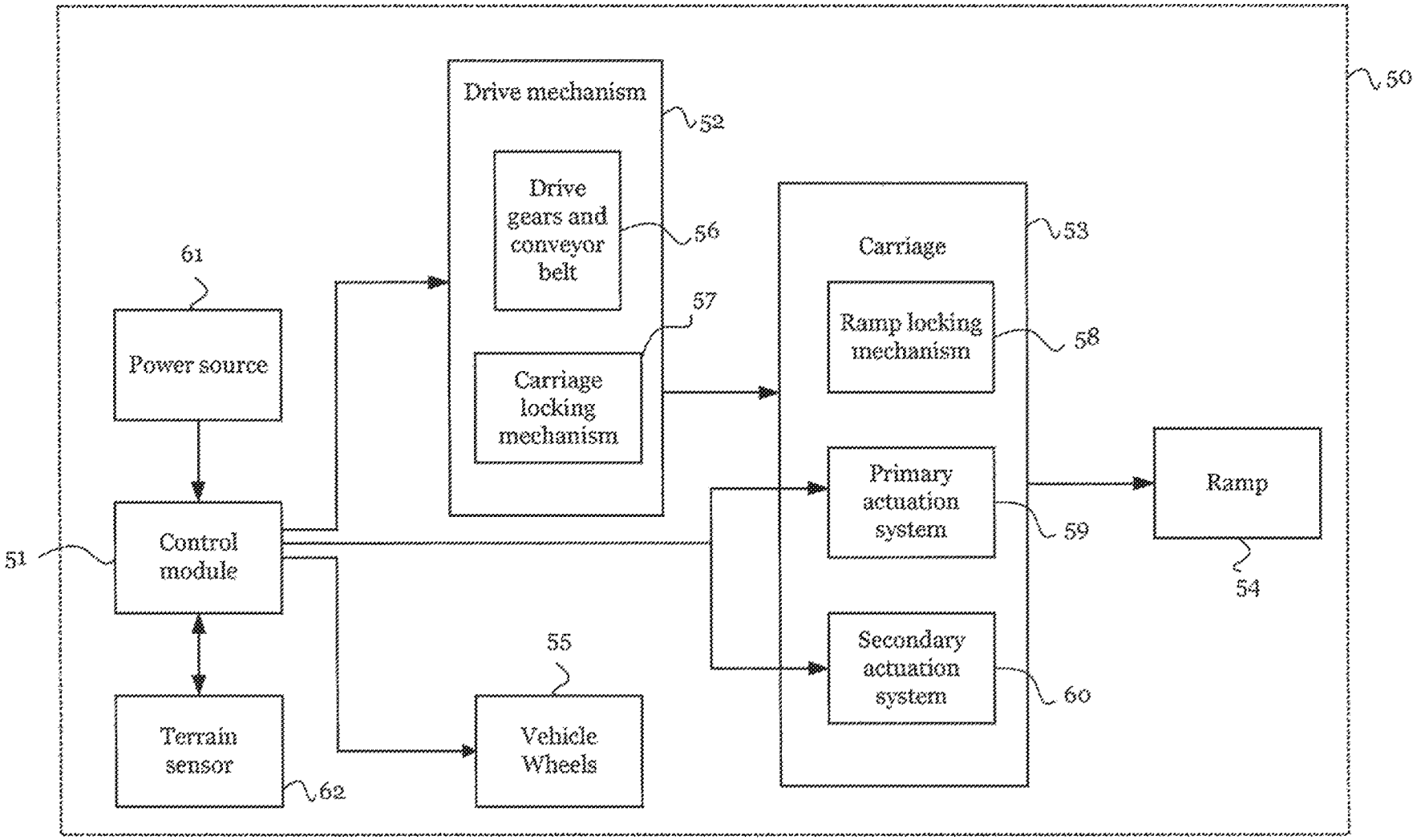
FIG. 13 is a system diagram of a ramp assembly according to an embodiment of the present invention.

FIG. 13 illustrates a system diagram of the active components a ramp assembly 50 according to an embodiment of the present invention. The term "active" used herein distinguishes from "passive" or fixed components such as mechanical housing, material effects, a guide track and so on, which are not illustrated. FIG. 13 illustrates a number of the optional components described above, specifically the vehicle wheels 55, the drive gears and conveyor belt 56, the carriage and ramp locking mechanisms 57, 58, a dedicated ramp assembly power source 61, and the terrain sensor 62, in order to illustrate their configuration if used.

Central to the operation of the ramp assembly 50 is a control module 51 mounted to the ramp assembly 50, which controls operation of the electrical and mechanical components. The control module 51 is illustrated as being powered by a power source 61. The control module 51 controls the operation of a drive mechanism 52 which is coupled to a carriage 53, which is in turn coupled to a ramp 54. The drive mechanism 52 drives movement of the carriage 53 around a substantially curvilinear loop, as described above, and may comprise drive gears 56 for effecting the driving of a conveyor belt, to which the carriage 53 is coupled. The drive mechanism 52 carries a locking mechanism 57 for locking the position of the carriage 53 on the curvilinear loop. The control module 51 controls the ramp locking mechanism 58, for locking the position of the carriage 53 relative to the ramp 54, and the primary and secondary actuation systems 59, 60 of the carriage 53. The primary actuation system 59 drives linear motion of the ramp 54 with respect to the carriage 53, while the secondary actuation system 60 drives angular or pivoting motion of the ramp 54 with respect to the carriage 53. In the present embodiment, the control module 51 drives the wheels 55 of the vehicle to which the ramp assembly 50 is coupled, and comprises the wheels 55 as an integral component of the ramp assembly 50. The control module 51 interfaces with a terrain sensor 62 to determine the presence of stepped terrain, and to control the start of a ramp deployment sequence. The control module 51 stores information relating to terrain such as recognised terrain profiles for future use.

It will be appreciated that a number of modifications to the present invention are possible and that aspects of different described embodiments which are compatible may be combined in order to achieve the driving of the ramp for a particular vehicle or terrain. The described embodiments are therefore not to be interpreted as restrictive, but as examples of the present invention, the scope of which is defined by the appended claims.

The invention claimed is:

1. A ramp assembly for a vehicle, the ramp assembly comprising:

a ramp for supporting one or more wheels of a vehicle and providing a bridge over stepped terrain on which the wheels of the vehicle can travel, wherein the ramp is configured to be movable between a first configuration in which the ramp is stowed in the ramp assembly, a second configuration in which the ramp extends from the ramp assembly, and a third configuration in which the ramp is arranged to support the wheels of the vehicle as it travels over the stepped terrain;

a drive mechanism for driving motion of the ramp with a conveyor belt and one or more drive gears for driving the conveyor belt;

a carriage coupling the conveyor belt to the ramp, the carriage having a primary actuation system to enable rotation of the ramp about a pivot, and a secondary actuation system to enable linear movement of the carriage along the ramp; and a control module for controlling the drive mechanism and the carriage such that a point of coupling of the carriage to the conveyor belt will be driven around a curvilinear loop and the ramp is configured to be driven in a cycle from the first configuration to the second configuration to the third configuration to the first configuration.

2. A ramp assembly according to claim 1, wherein the drive mechanism comprises:

a guide track arranged around the conveyor belt and configured to support the carriage as it is driven around the curvilinear loop.

3. A ramp assembly according to claim 1, comprising:

a carriage locking mechanism for locking a position of the carriage on the curvilinear loop by locking the position of the carriage with respect to the drive mechanism.

4. A ramp assembly according to claim 1, comprising:

a ramp locking mechanism for locking a position of the ramp with respect to the carriage.

5. A ramp assembly according to claim 1, comprising:

sensing means for sensing stepped terrain, wherein the control module is configured to control the drive mechanism and the carriage in accordance with information received from the sensing means such that the ramp assembly will enable a vehicle to travel over the stepped terrain on the ramp.

6. A ramp assembly according to claim 5, wherein the carriage comprises:

a rotary drive means for driving rotation of the ramp about a rotation axis of the rotary drive means when the carriage is positioned towards an end of the ramp, and the control means is configured to control the rotary drive means to control an angle of rotation of the ramp.

7. A ramp assembly according to claim 6, wherein the ramp is telescopic, and the control module is configured to control extension of the ramp in accordance with information received from the sensing means and the angle of rotation of the ramp.

8. A ramp assembly according to claim 1, in combination with a vehicle, wherein the ramp comprises:

two or more elongate portions, each elongate portion being arranged to support a respective one or more wheels of the vehicle.

9. A ramp assembly according to claim 1, comprising:

a plurality of wheels, the ramp assembly being arranged in a space surrounded by the plurality of wheels.

10. A wheeled vehicle comprising:

a vehicle chassis; and the ramp assembly of claim 1.

11. A wheeled vehicle according to claim 10, which is a wheelchair, wherein the first configuration is such that the ramp is positioned above the wheels of the wheelchair.

12. A wheeled vehicle according to claim 11, wherein the control module is configured to suspend operation of the drive mechanism when the ramp is in the third configuration and the wheelchair is driven over stepped terrain on the ramp, and the secondary actuation system is configured to be driven by the driving of the wheelchair to move the carriage from the front of the ramp to the rear of the ramp;

wherein after the wheelchair has travelled over the ramp, the ramp is arranged to extend to a rear of the wheelchair, and the control module is configured to reactivate control of the drive mechanism to drive the ramp to the first configuration.

13. A wheeled vehicle according to claim 11, wherein the control module is configured to control the drive mechanism to drive the wheelchair on the ramp.

14. A ramp assembly for a vehicle, the ramp assembly comprising:

a ramp for supporting one or more wheels of a vehicle and providing a bridge over stepped terrain on which the wheels of the vehicle can travel, wherein the ramp is arranged to be movable between a first configuration in which the ramp is stowed in the ramp assembly, a second configuration in which the ramp extends from the ramp assembly, and a third configuration in which the ramp is arranged to support the wheels of the vehicle as it travels over the stepped terrain;

a drive mechanism for driving motion of the ramp with a rack and pinion system;

a carriage coupling the drive mechanism to the ramp, wherein the rack is a looped guide track arranged to support the carriage, and the carriage is coupled to the pinion mounted on the rack, the carriage having a primary actuation system to enable rotation of the ramp about a pivot, and a secondary actuation system to enable linear movement of the carriage along the ramp; and a control module for controlling the drive mechanism and the carriage such that the pinion will be driven along the rack around a curvilinear loop and the ramp is configured to be driven in a cycle from the first configuration to the second configuration to the third configuration to the first configuration.

15. A ramp assembly according to claim 14, comprising:

a carriage locking mechanism for locking a position of the carriage on the curvilinear loop by locking the position of the carriage with respect to the drive mechanism.

16. A ramp assembly according to claim 14, comprising:

a ramp locking mechanism for locking a position of the ramp with respect to the carriage.

17. A ramp assembly according to claim 14, comprising:

sensing means for sensing stepped terrain, wherein the control module is configured to control the drive mechanism and the carriage in accordance with information received from the sensing means such that the ramp assembly will enable a vehicle to travel over the stepped terrain on the ramp.

18. A ramp assembly according to claim 14, in combination with a vehicle, wherein the ramp comprises:

two or more elongate portions, each elongate portion being arranged to support a respective one or more wheels of the vehicle.

19. A ramp assembly according to claim 14, comprising:

a plurality of wheels, the ramp assembly being arranged in a space surrounded by the plurality of wheels.

20. A wheeled vehicle comprising:

a vehicle chassis; and the ramp assembly of claim 14.

* * * * *